United States Patent [19]

Dolby

[11] 4,098,270

[45] Jul. 4, 1978

[54] SMOKE MASK APPARATUS

[75] Inventor: John T. Dolby, Hubbard Woods, Ill.

[73] Assignee: BBDM, Inc., Chicago, Ill.

[21] Appl. No.: 735,452

[22] Filed: Oct. 26, 1976

[51] Int. Cl.[2] ..... A62B 7/00

[52] U.S. Cl. ..... 128/141 R; 128/147; 128/142.6; 128/142.4

[58] Field of Search ..... 128/139, 140 R, 141 R, 128/142 R, 142.2, 142.6, 145 R, 146 R, 146.2, 146.6, 147, 191 R, 201

[56] References Cited

U.S. PATENT DOCUMENTS

| | | | |
|---|---|---|---|
| 703,948 | 7/1902 | Muntz | 128/142.6 |
| 1,320,935 | 11/1919 | Schwartz | 128/142.6 |
| 2,665,686 | 1/1954 | Nood et al. | 128/142.6 |

FOREIGN PATENT DOCUMENTS

| | | | |
|---|---|---|---|
| 21,098 of | 1913 | United Kingdom | 128/141 R |
| 324,909 | 1/1930 | United Kingdom | 128/142.6 |

*Primary Examiner*—Robert W. Michell
*Assistant Examiner*—Henry J. Recla
*Attorney, Agent, or Firm*—Merriam, Marshall & Bicknell

[57] ABSTRACT

A smoke mask comprises a transparent face shield covering a wearer's nose and eyes in a substantially airtight manner, and a replaceable air filtration cartridge system attached to the face shield and provided with a conduit leading into the mouth of the wearer, through which he breathes. Exhaled air passes through the air filter in a reverse direction from that inhaled and never comes into contact with the interior surface of the lens in the face shield, thus eliminating the possibility of fogging.

6 Claims, 6 Drawing Figures

FIG. 1
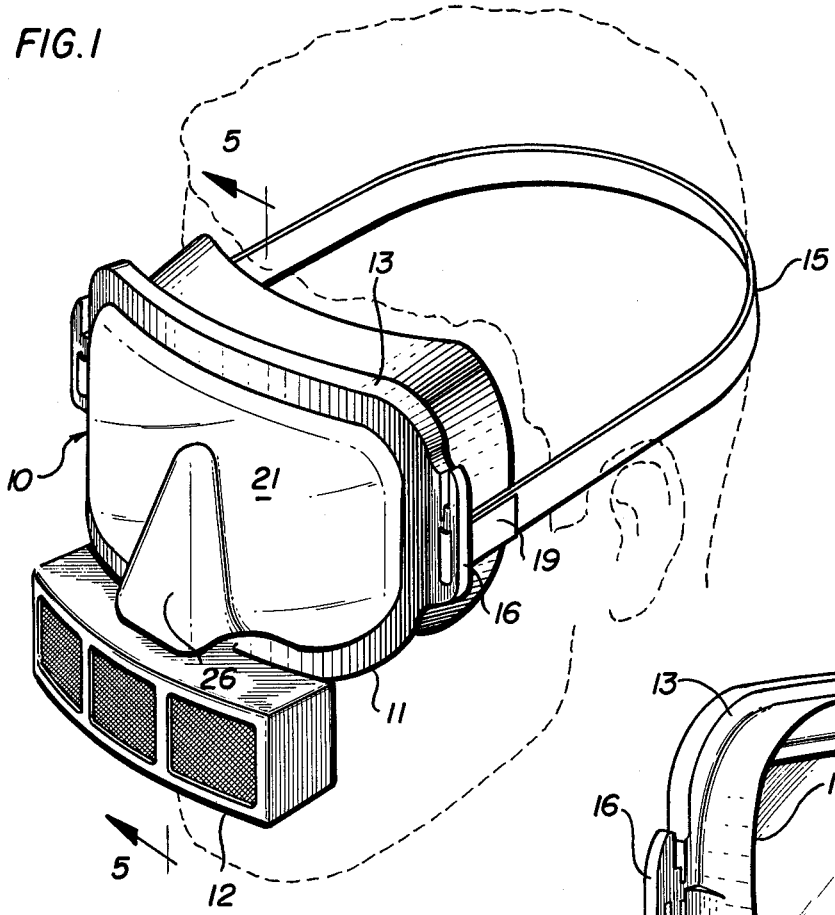
FIG. 2
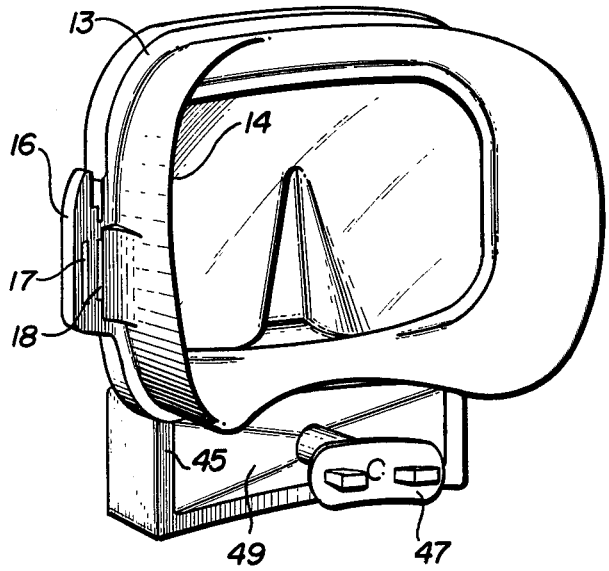
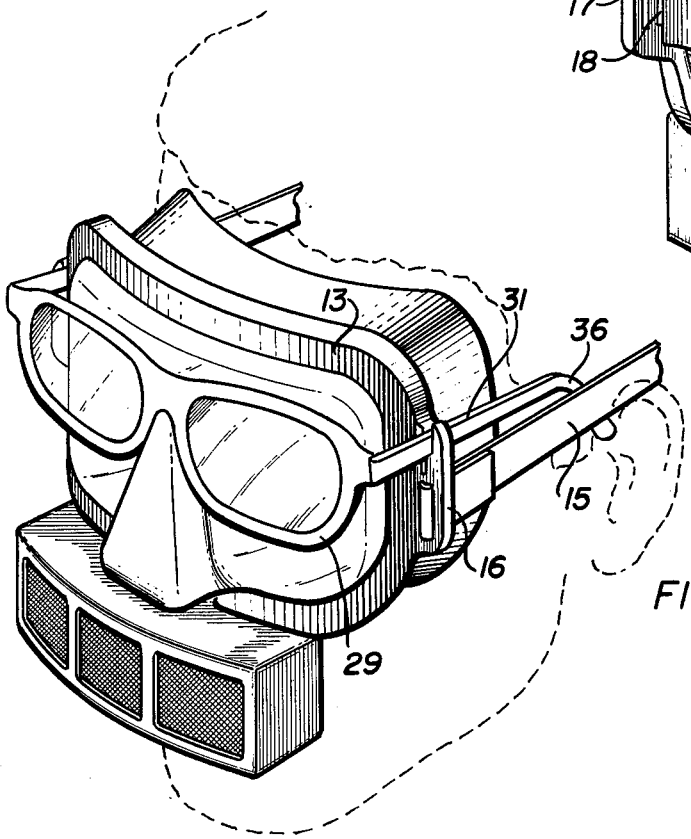
FIG. 3

FIG. 4
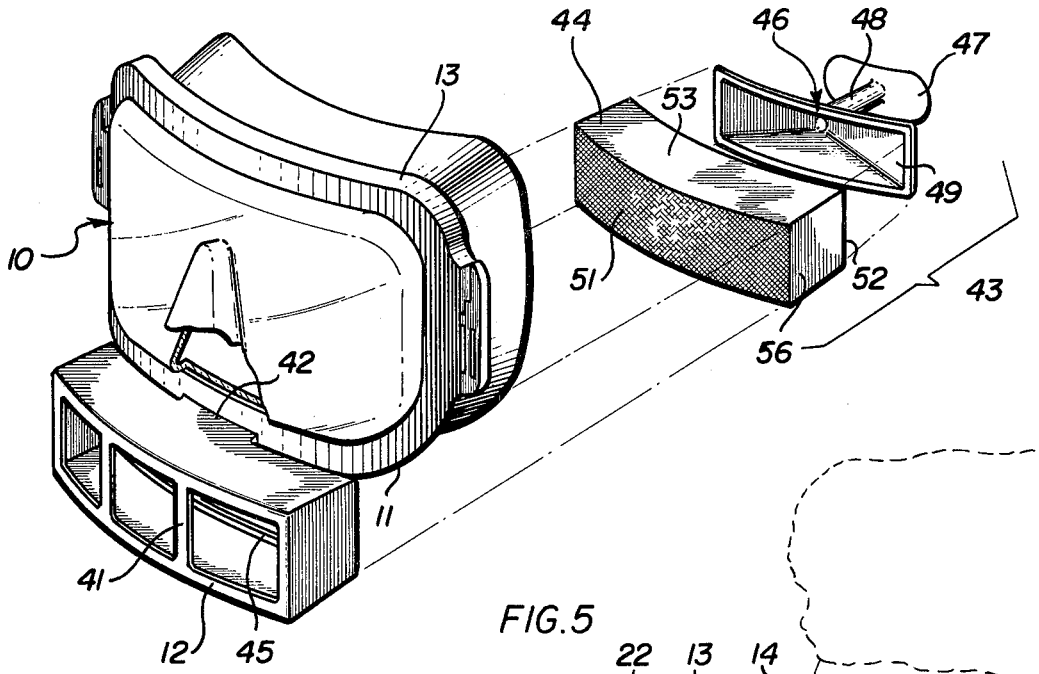
FIG. 5
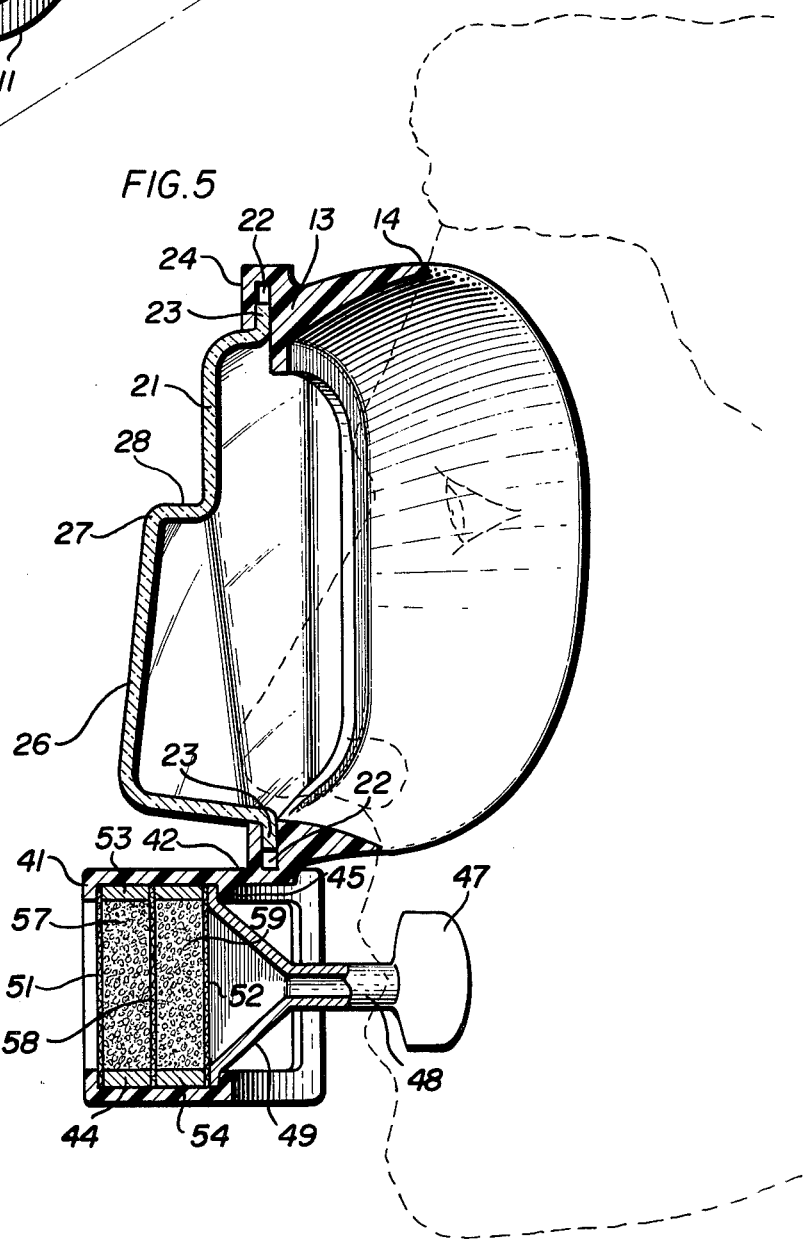
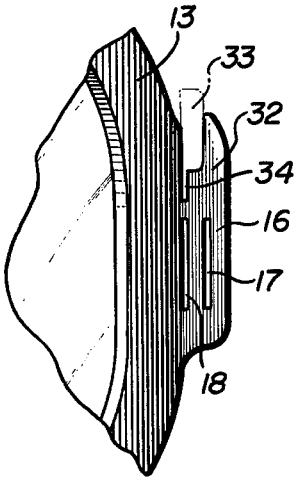
FIG. 6

SMOKE MASK APPARATUS

The present invention relates to gas or smoke masks and more particularly to a simple, relatively low cost smoke mask for use by the general public for protection against noxious gas and smoke fumes in emergency situations arising from building fires.

Among the known types of gas mask apparatus are those intended primarily for use by military, police and fire-fighting personnel in the course of their duties. Such gas masks, as exemplified by those shown in U.S. Pat. Nos. 2,741,246, 2,775,967, and 3,633,575, are generally of the full-face type, designed to cover the wearer's eyes, nose and mouth and provided with lenses. In addition to being relatively expensive because of complex construction, such masks generally require the user to exhale into the mask, thus creating problems with fogging of the lenses created by the moisture in the user's breath. In order to avoid fogging, some masks are provided with refinements such as baffles or nosecups intended to divert the moist air from contact with the lenses, as shown, for example, in U.S. Pat. No. 2,910,979. The size and complexity of such gas masks makes them cumbersome and expensive, and thus not attractive for purchase by members of the general public as safety devices for emergency use in the event of a building fire.

There are also known relatively simple, inexpensive respirators, intended to remove particulate matter from the air breathed by the wearer, such as those shown in U.S. Pat. Nos. 2,634,724, 3,500,825, 3,757,777, and 3,779,244. These respirators cover only the wearer's nose and mouth and therefore have no lenses subject to fogging. In addition to the relatively ineffective action of such respirators against heavy smoke, the lack of eye protection creates a problem which can be serious in the event of a building fire. Contact of smoke with the wearer's eyes can render the wearer of such a respirator practically blind and unable to find a way out of a burning building.

In accordance with the present invention, there is provided a smoke mask of simple construction which provides not only protection for the wearer's eyes but also effective filtration of the air inhaled by the wearer, while avoiding the possibility of lens fogging. This result is achieved by a construction having two main assemblies, a transparent face shield covering the wearer's nose and eyes in a substantially airtight manner, and a replaceable air filtration cartridge system attached to the face shield and provided with a conduit leading into the mouth of the wearer, through which he breathes. Exhaled air passes through the air filter in a reverse direction from that inhaled and never comes into contact with the interior surface of the lens in the face shield, thus eliminating the possibility of fogging. In addition, since the wearer can quickly remove the conduit from his mouth vocal communication is not inhibited, as is the case with masks of the full-face type.

The smoke mask of the invention is simple in construction and hence relatively inexpensive. Further, since the air filtration cartridge is easily replaceable, the mask can be kept in good operating condition at minimum expense.

The invention will be better understood from the following detailed description thereof, taken in conjunction with the accompanying drawings, in which:

FIG. 1 is an isometric view of the smoke mask of the invention, as it would appear in use on the face of a wearer;

FIG. 2 is an isometric view from the rear of the mask shown in FIG. 1;

FIG. 3 is a view similar to that of FIG. 1 illustrating clip means on the mask for holding a wearer's eyeglasses in operative position;

FIG. 4 is an exploded isometric view showing the construction of the cartridge filter used in the invention, and also having a portion of the nose piece broken away to show the connection between the face shield and the filtration system;

FIG. 5 is a vertical sectional view along the line 5—5 of FIG. 1, and FIG. 6 is a fragmentary view of one side of the mask of the invention, showing a clip used for fastening the head harness and for holding the ear piece of eyeglasses.

As shown in the drawings, in a preferred embodiment, a smoke mask 10 of the invention consists of two major portions, an upper face mask assembly 11 and a lower filtration cartridge assembly 12, connected to the lower edge of the face mask assembly.

Face mask assembly 11 comprises a face piece in the form of a frame 13 which is roughly oval in shape and of a size and configuration adapted to encircle the wearer's eyes and nose, leaving the mouth free. Frame 13 is formed of a resilient material, suitably natural or artificial rubber, polyethylene, polypropylene, or the like. The inner or face-contacting side of the frame terminates in a tapering flexible edge 14 which when pressed against the wearer's face with light force forms a substantially airtight seal extending across the wearer's forehead, down each of his temples and across his upper lip. As shown in FIG. 1, in use the face piece is held in position on the wearer's face by means of head harness 15 comprising an elastic strap or the like, the ends of which are fastened to mounting posts 16 on either side of frame 13. As shown (FIG. 2), each post 16 is provided with two parallel vertical slits 17 and 18. Each end of harness 15 is passed from the rear through inner slit 18 then reversed and passed through outer slit 17, leaving convenient tabs 19 which can be manipulated by the wearer for achieving a proper seal of the face piece on the wearer's face.

In order to permit the wearer to see through the mask, there is provided a transparent lens or eye shield 21 which forms the front surface of the face mask assembly. The edges of shield 21 are attached to frame 13 in any convenient manner which provides a substantially airtight joint therebetween. A preferred manner of attachment of the eye shield to the frame is shown in FIG. 5. The forward outer edge of frame 13 is provided with an inwardly opening channel 22 extending around the entire periphery of the frame. Eye shield 21 has an outwardly extending peripheral flange 23 of a size adapted to enter channel 22. The eye shield is inserted by outwardly bending outer lip 24 forming one side of channel 22 sufficiently to permit entry of flange 23 of eye shield 21, lip 24 being sufficiently resilient to hold eye shield 21 in position while forming an essentially airtight joint.

In a preferred embodiment shown in the figures, eye shield 21 is provided with an outwardly protruding nose section 26, the inner side of which forms a recess conforming in general outline and location to a wearer's nose. In addition to providing clearance for the wearer's nose, section 26 provides means for supporting eyeglasses which may be used by the wearer. As shown, the upper end 27 of nose section 26 tapers to a size approximating the width of a wearer's nose at the level of his eyes. The horizontal outwardly projecting upper surface 28 of section 26 is designed to support the nose piece of eyeglasses 29, as shown in FIG. 3. The ear piece 31 of the glasses is supported within a slot defined by the edge of frame 13 and an upwardly extending integral tab 32 on post 16. Tab 32 has two sections of different width which define with the edge of frame 13 two slots, an upper slot 33 which is wide enough to accomodate relatively thick ear pieces, such as those on tortoise-shell glasses, and a lower narrower slot 34 of a size adapted to receive the ear pieces of wire frames. While the curved end 36 of an ear piece of eyeglasses held on the mask do not extend far enough back to engage the wearer's ear in normal fashion, the end can be slipped under harness 15 as shown in FIG. 3, whereby the glasses are held firmly to the face mask, permitting the wearer to look through the transparent eye shield 21 and the glasses simultaneously.

While the preferred embodiment shown in the figures and described above incorporates a protruding nose section 26, it should be understood that this is not a necessary aspect of the invention. It will be obvious that frame 13 can be so proportioned to position eye shield 21 sufficiently forward of the wearer's face to provide adequate clearance for his nose. In such case, a support for use with eyeglasses as described can be attached to or formed within the eye shield at a level adapted to support the nose piece of eyeglasses.

Although the face mask assembly 11 of the smoke mask protects the eyes of the wearer against contact with smoke which might affect his vision, the face mask has no provision for supplying purified air to permit the wearer to breathe. This function is provided by the filtration cartridge assembly 12 which is connected to the lower edge of the face mask assembly.

Filtration cartridge assembly 12 comprises a hollow cartridge-supporting frame 41 having a roughly rectangular configuration, the front and rear surfaces of which are essentially open. Frame 41 is attached to the lower edge of face mask frame 13 by means of a narrow strip 42 (FIG. 4) of resilient material. In a preferred embodiment, face frame 13, cartridge frame 41 and interconnecting strip 42 are formed as an integral unitary structure, the material of which is sufficiently resilient to permit strip 42 to act as a hinge, permitting frame 41 to move in a back-and-forth direction relative to frame 13.

Removably held within frame 41 is filtration cartridge assembly 43, consisting of air filter cartridge 44 and mouth piece assembly 46, shown in exploded form in FIG. 4. Peripheral flange 45 on the rear face of frame 41 holds cartridge 44 securely in place while permitting it to be readily removed when necessary.

As shown in FIG. 5, during use of the mask, air filter cartridge 44 is held by cartridge frame 41 in a position which permits the wearer to take mouthpiece 47 into his mouth and to close his lips over conduit 48 in a manner which prevents external smoke-laden air from entering his lungs. Conduit 48 is connected to air gathering baffle 49 which has a peripheral configuration conforming to that of filter cartridge 44. The front and rear surfaces 51 and 52 respectively of filter cartridge 44 are open for passage of air therethrough, while the bottom and top surfaces 53 and 54 and the ends, e.g. 56, are closed. When the wearer of the mask inhales, air is drawn through the filter cartridge 44, baffle 49, conduit 48, and mouthpiece 47 into his lungs. The contents of cartridge 44 remove smoke particles and noxious gases from the air passing through, thus permitting the user of the mask to breathe in safety. The specific active elements of the cartridge filter can obviously be varied, depending on the nature of the smoke or other gases which are encountered during the intended use of the mask. It is contemplated, therefore, that the cartridge can contain any known filtering and gas absorbing elements, as required by the particular circumstances of use.

For general use, under the conditions encountered during typical fires in houses, apartment buildings and the like, it has been found that a cartridge having the construction illustrated in the drawings can be used. This cartridge uses as the front surface 51 a very low-resistance sheet filter composed of glass fibers and organic binders and having a thickness of about 0.017 inches (Type H-60FG, available from Hollingsworth & Vose Co. East Walpole, Mass). The filter has a DOP smoke penetration rating (MILF-51079 A) of 85% and air permeability (cu. ft. per sq. ft. under 0.5 inch of water) of 110 cfm. Adjacent filter 51 is a ½ inch-thick layer 57 of activated carbon, type ASC (Activated Carbon Division of Calgon Corp.), a granular activated carbon impregnated with metallic oxides and used in military type gas masks. Adjacent the first layer 57 of activated carbon is a sheet filter 58 of medium porosity composed of glass fibers and organic binders, having a thickness of about 0.019 inches, DOP smoke penetration of 2% and air permeability of 8.0 cfm (Type H-95F, Hamilton & Vose Co.). Adjacent filter 58 is another ½ inch-thick layer 59 of activated carbon (Type PCB, Activated Carbon Division of Calgon Corp.), a coconut shell base activated carbon used for adsorption of organic vapors such as alcohol, chlorinated hydrocarbons, esters, ketones, ethers, hydrocarbons and aromatics. The final element in cartridge 44 is another glass fiber filter 52 (Type H-95F).

In a test of a filter having the described construction and an air-flow cross sectional area of about 4 square inches, combustion products generated by a smoldering fire of cloth, cotton, wood and the like were sucked through the filter cartridge. After ten minutes of smoke filtration at a rate of one cubic foot per minute, the pressure drop across the filter was 1.5 inches of water. During this period the upstream mass of smoke, i.e., before the filter cartridge, was 3.8 mg per cubic foot, while the downstream mass of smoke after the filter was 0.01 mg per cubic foot, indicating an efficiency in smoke removal of over 99.7%. The indicated life of greater than 10 minutes is sufficient to permit the wearer to escape from a burning building under typical circumstances without being overcome by smoke and associated noxious fumes.

The foregoing detailed description has been given for clearness of understanding only, and no unnecessary limitations should be understood therefrom, as modifications will be obvious to those skilled in the art.

I claim:

1. A smoke mask comprising a face piece provided with means to form a substantially airtight cover over the eyes and nose of a wearer, leaving the mouth exposed, at least a portion of said face piece to cover said eyes being transparent;

head harness means for holding said face piece in position over said eyes and nose;

a filtration cartridge holder attached to and depending below said face piece adapted to be front of said mouth;

resilient means attaching said holder to said face piece, said resilient means permitting said holder to be moved toward and away from said mouth;

a removable air filtration cartridge held in said holder;

mouthpiece means adapted to be held in the mouth of a wearer and a conduit operatively connected between said cartridge and said mouthpiece means.

2. A smoke mask comprising first resilient frame means adapted to encircle a wearer's eyes and nose in sealing engagement with the skin, leaving the mouth exposed;

a transparent eye shield held in said frame and making a substantially air-tight joint therewith;

head harness means attached to said frame for holding said frame in operative position;

second frame means adapted to receive and hold an air filtration cartridge;

hinge means interconnecting said first and second frame means, said hinge means positioning said second frame means in front of, and permitting said second frame means to be moved toward and away from, said wearer's mouth;

a removable air filtration cartridge held by said second frame, said cartridge including means adapted to remove noxious gases and smoke particles from an air stream passing therethrough;

a mouthpiece including means adapted to be held in the mouth of said wearer; and an air-flow conduit operatively connected between said mouthpiece and said cartridge, permitting said wearer to inhale and exhale through said cartridge.

3. The mask of claim 2 wherein said first and second frame means are integrally formed as a unitary structure of a resilient material, a thin strip of said material joining said frame means and acting as a hinge to permit relative back-and-forth movement of said second frame means.

4. The mask of claim 2 which is provided with a resilient tab on each lateral edge of said mask at approximate eye-level and an outwardly extending projection on the front face of said eyepiece, said tabs and projection being adapted to support the frame of eyeglasses in operative position for use by the wearer of said mask.

5. The mask of claim 2 in which said second frame means has a generally rectangular configuration including opposed top and bottom faces, opposed end faces, a front face provided with openings for air flow into said filtration cartridge, and a substantially open rear face permitting said cartridge to be inserted and removed from said frame.

6. The mask of claim 5 in which said rear face is provided with an inwardly extending peripheral lip for holding said cartridge in position.

* * * * *